US006953350B2

(12) United States Patent
Shiu

(10) Patent No.: US 6,953,350 B2
(45) Date of Patent: Oct. 11, 2005

(54) STRADDLE ELECTRICAL CONNECTOR WITH TWO-STAGE CONNECTING CLAMP

(75) Inventor: Guo-Jiun Shiu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/903,219

(22) Filed: Jul. 30, 2004

(65) Prior Publication Data

US 2005/0026473 A1 Feb. 3, 2005

(30) Foreign Application Priority Data

Jul. 30, 2003 (TW) ..... 92213901 U

(51) Int. Cl.[7] ..... H01R 12/00
(52) U.S. Cl. ..... 439/79
(58) Field of Search ..... 439/632, 79, 59, 439/265, 635, 80, 81, 876

(56) References Cited

U.S. PATENT DOCUMENTS 4,060,300 A * 11/1977 Jayne et al. ..... 439/267
4,179,177 A * 12/1979 Lapraik ..... 439/267
4,606,594 A * 8/1986 Grabbe et al. ..... 439/267
5,584,708 A * 12/1996 Leong ..... 439/79
6,368,129 B1 * 4/2002 Wang et al. ..... 439/260
6,618,942 B2 * 9/2003 Beaman et al. ..... 29/854
6,644,995 B1 * 11/2003 Jones et al. ..... 439/260
6,679,716 B2 * 1/2004 Nakagawa et al. ..... 439/267
6,751,862 B2 * 6/2004 Hamatani et al. ..... 29/854
6,790,055 B1 * 9/2004 Shiu et al. ..... 439/79

* cited by examiner

*Primary Examiner*—Tulsidas C. Patel
*Assistant Examiner*—Harshad C. Patel
(74) *Attorney, Agent, or Firm*—Wei Te Chung

(57) ABSTRACT

A straddle electrical connector (1) attached to a circuit substrate (50) includes a housing (10), upper contacts (30) and lower contacts (40) accommodated in the housing, and a clamp (20) attached with the housing. Each upper contact includes an upper connecting portion (36) and an upper soldering portion (38). Each lower contact includes a lower connecting portion (46) and a lower soldering portion (48). The distance between the upper soldering portion and corresponding lower soldering portion is greater than the thickness of the circuit substrate. When the circuit substrate is inserted into the connector, the clamp presses the upper contacts and corresponding lower contacts face to face. This reduces the distance. Thereby the upper soldering portion and the lower soldering portion cooperatively engage with the circuit substrate.

15 Claims, 5 Drawing Sheets

8

STRADDLE ELECTRICAL CONNECTOR WITH TWO-STAGE CONNECTING CLAMP

BACKGROUND OF THE INVENTION

1. Field of the Invention

The present invention relates to an electrical connector, and particularly to a straddle electrical connector having a two-stage connecting clamp attached to an edge of a circuit substrate such as a printed circuit board (PCB). The instant invention relates to a contemporarily filed application, Ser. No. 10/650,382 filed Aug. 27, 2003 with the same title and assignee with the instant application.

2. Description of Prior Art

So-called straddle electrical connectors are connected to edges of circuit boards, the circuit boards having electrical traces on both surfaces thereof. The straddle electrical connector has two rows of electrical contacts, each contact having a contact section. The edge of the circuit board is inserted between the rows of contact sections of the straddle connector. The contacts are connected to corresponding electrical traces using soldering techniques such as surface mount technology (SMT).

An example of a conventional straddle connector is shown in FIG. 6. The connector 8 is for being attached to an edge of a printed circuit board (PCB) 85. The connector 8 comprises an insulative housing 80, and a number of electrical contacts 81 arranged in two rows in the housing 80. Under normal conditions, contact sections 811 of the contacts 81 are inclined toward each other due to their resilience. The circuit board 85 comprises conductive pads 851, 852 on both surfaces of an edge, and solder coatings 853, 854 attached to the conductive pads 851, 852 respectively. A distance between soldering sections 812 of the contact sections 811 is less than an overall thickness of the circuit board 85 at the solder coatings 853, 854. Once the connector 8 is engaged on the edge of the circuit board 85, the contact sections 811 are soldered to corresponding conductive pads 851, 852 using an infra red light source or another kind of heat source.

When the connector 8 is mounted on the circuit board 85, the contact sections 811 are prone to scrape the solder coatings 853, 854 off from the conductive pads 851, 852. This is because the distance between the soldering sections 812 of the contact sections 811 is less than the overall thickness of the circuit board 85 at the solder coatings 853, 854. On the other hand, if the distance between the soldering sections 811 were greater than the overall thickness of the circuit board 85, it would be highly problematic or impossible to solder the soldering sections 811 to conductive pads 851, 852 via the solder coatings 853, 854. Yet when the solder coatings 853, 854 are scraped off, adequate soldering of the soldering sections 812 to the conductive pads 851, 852 cannot be obtained. Therefore, the reliability of the soldered connections may be substantially reduced.

A number of efforts has been made to improve the reliability of SMT techniques. For example, FIG. 7 shows a straddle connector 9 as disclosed in U.S. Pat. No. 5,584,708. The connector 9 comprises an insulative housing 91, electrical contacts 92 arranged in two rows in the housing 91, and a dielectric separator 93 movably located in a channel 923 of the housing 91. The housing 91 is molded from a suitable insulative plastic, and has a flat configuration for insertion of an edge of a circuit board 95 into the channel 923. Spaced conductive pads 951 are located on both surfaces of the circuit board 95 at the edge thereof. The conductive pads 951 are coated with solder (not shown). Connection sections 921 of the contacts 92 are brought to a position suitable for SMT connection. A distance between the opposite connection sections 921 of the contacts 92 is less than a thickness of the circuit board 95. Guide ends 9211 of the connection sections 921 are cooperatively flared for facilitating insertion of the circuit board 95.

Before the connector 9 is connected to the circuit board 95, the separator 93 is retained in the channel 923 near a mating face of the connector 9. The separator 93 keeps the connection sections 921 spaced apart so as not to touch the conductive pads 951 of the circuit board 95. When the circuit board 95 is inserted in the channel 923, a leading edge of the circuit board 95 comes into contact with the separator 93, and pushed the separator 93 further into the channel 923. When the circuit board 95 is completely inserted in the channel 923, the separator 93 is disposed in an inmost part of the channel 923. As a result, the connection sections 921 resiliently rebound and press onto the conductive pads 951. That is, when the connector 9 is connected to the edge of the circuit board 95, the distance between the connection sections 921 automatically changes to freely receive and then engage the circuit board 95. During this process, the connection sections 921 do not scrape solder from the conductive pads 951.

However, the connector 9 requires the flared guiding ends 9211 at distal ends of the contacts 92 in order to guide the circuit board 95 into the channel 923. Therefore, when the contacts 92 are soldered to the circuit board 95, the molten solder cannot completely cover the guiding ends 9211. As a result, when the connector 9 transmits high-frequency signals in operation, the guiding ends 9211 are prone to produce cross talk. The performance and specifications of the connector 9 are diminished.

A new straddle electrical connector that overcomes the above-mentioned disadvantages is desired.

SUMMARY OF THE INVENTION

Accordingly, an object of the present invention is to provide a straddle electrical connector for attachment to a circuit substrate such as a printed circuit board (PCB), wherein the connector does not scrape solder coatings off from conductive pads of the PCB during attachment.

Another object of the present invention is to provide a straddle electrical connector for attachment to a circuit substrate such as a PCB, wherein the connector greatly reduces or even eliminates cross talk during transmitting high-frequency signals.

To achieve the above-mentioned objects, a straddle electrical connector in accordance with a preferred embodiment of the present invention is for being attached to a PCB. The connector comprises a housing, upper contacts and lower contacts accommodated in the housing, and a clamp attached with the housing. Each upper contact comprises an upper connecting portion and an upper soldering portion. Each lower contact comprises a lower connecting portion and a lower soldering portion. The distance between the upper soldering portion and corresponding lower soldering portion is greater than the thickness of the PCB. Thus the PCB is put between the upper contacts and the lower contacts with zero insertion force. When the PCB is inserted further, the clamp is pushed by the PCB to slide toward the housing. During this process, the clamp presses the upper contacts and corresponding lower contacts face to face. This results in the distance between the upper soldering portion and the lower soldering portion reduced. Thereby the upper soldering portion and the lower soldering portion cooperatively engage with the circuit substrate.

Other objects, advantages and novel features of the invention will become more apparent from the following detailed description when taken in conjunction with the accompanying drawings, in which:

DETAILED DESCRIPTION OF THE PREFERRED EMBODIMENT OF THE INVENTION

Reference will now be made to the drawings to describe the present invention in detail.

Figure 1:
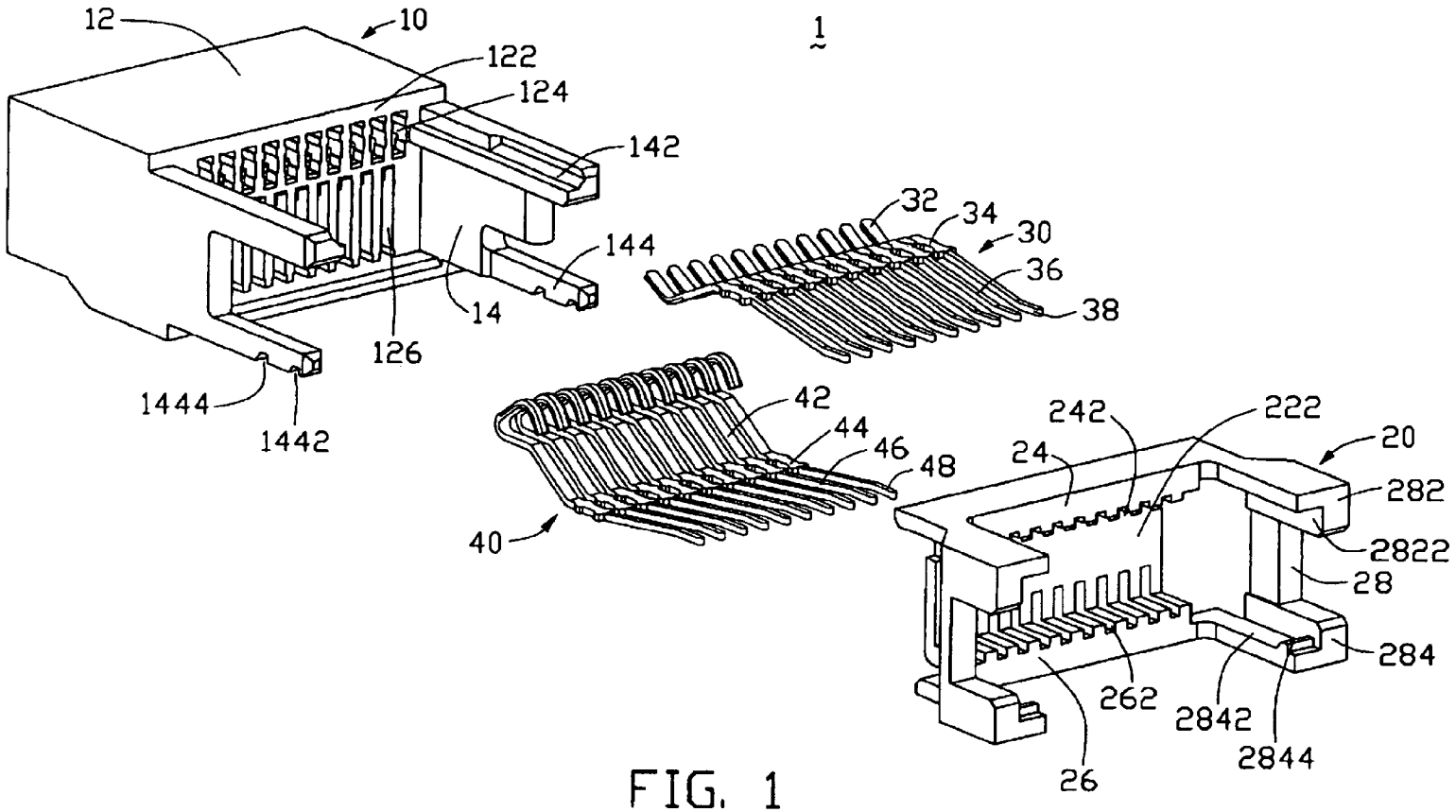
FIG. 1 is an exploded, isometric view of a straddle electrical connector in accordance with the preferred embodiment of the present invention.

FIG. 1 shows essential parts of a straddle connector 1 in accordance with the preferred embodiment of the present invention. The connector 1 is for being attached to an edge of a printed circuit board (PCB) 50 (see FIG. 4). The connector 1 comprises an insulative housing 10, a clamp 20 attached with the housing 10, and a row of upper contacts 30 and a row of lower contacts 40 partly accommodated in the housing 10.

The housing 10 comprises a body 12 with a contacting surface 122 defined thereon, and a pair of extending portions 14 extending in a same direction from opposite ends of the contacting surface 122 respectively. The body 11 defines a row of upper passageways 124, and a row of lower passageways 126. Each extending portions 14 comprises an upper part 142 and a lower part 144. The lower part 144 defines a positioning slot 1442 in a bottom of distal end portion thereof; and a retaining slot 1444 adjacent the positioning slot 1442, between the positioning slot 1442 and the contacting surface 122.

Figure 2:
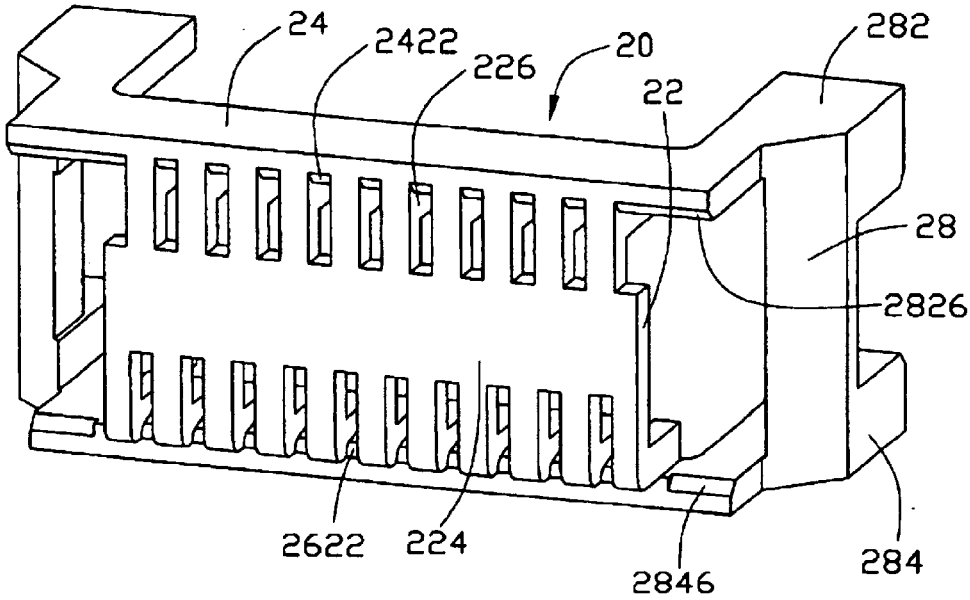
FIG. 2 is an enlarged view of a clamp of the connector of FIG. 1, viewed from another aspect.

FIG. 2 is an enlarged view of the clamp 20 of the connector 1, but viewed from another aspect. Referring to FIGS. 1 and 2, the clamp 20 comprises a base portion 22, a first receiving portion 24 and a second receiving portion 26 perpendicularly extending from opposite top and bottom ends of the base portion 22 respectively, and a pair of supporting portions 28 respectively interconnecting opposite ends of the first receiving portion 24 with corresponding opposite ends of the second receiving portion 26.

The base portion 22 is flat and comprises a front surface 222, a back surface 224, and an upper and a lower rows of parallel through slots 226 spanning between the front surface 222 and the back surface 224. The through slot 226 are defined at opposite top and bottom portions of the base portion 22 respectively. The first receiving portion 24 defines a plurality of first receiving slots 242 therein; the first receiving slots 242 respectively communicating with corresponding upper through slots 226. The second receiving portion 26 defines a plurality of second receiving slots 262 therein; the second receiving slots 262 respectively communicating with corresponding lower through slots 226.

Figure 4:
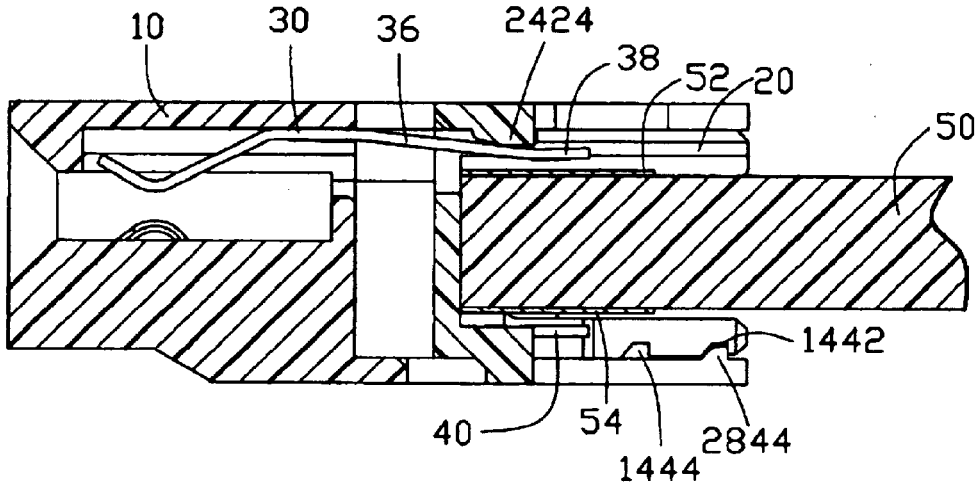
FIG. 4 is a cross-sectional view of FIG. 3 taken along line IV—IV thereof, and showing a cross-section of an edge portion of a PCB partly inserted into the connector.

The first receiving portion 24 forms a plurality of first pressing blocks 2424 at corresponding first receiving slots 242 (shown in FIG. 4). The second receiving portion 26 forms a plurality of second pressing blocks (not shown) at corresponding second receiving slots 262. The second pressing blocks are as same as the first pressing block 2424. A plurality of first slantwise guiding faces 2422 is defined in the first receiving portion 24 at corresponding first receiving slots 242. A plurality of second slantwise guiding faces 2622 is defined in the second receiving portion 26 at corresponding second receiving slots 262. The first guiding faces 2422 and the second guiding face 2622 respectively adjoin the back surface 224 of the base portion 22.

Each supporting portion 28 comprises an upper arm 282 and a lower arm 284. Each upper arm 282 defines an upper engaging surface 2822 on a bottom thereof. Each lower arm 284 defines a lower engaging surface 2842 on a top thereof. An upper guiding portion 2826 is defined at a distal end of each upper engaging surface 2822. A lower guiding portion 2846 is defined at a distal end of each lower engaging surface 2842. The upper guiding portion 2822 and the lower guiding portion 2846 are near the base portion 22. A block 2844 is defined at an opposite distal end of each lower engaging surface 2842.

Referring to FIG. 1, each upper contact 30 comprises, in sequence, an upper contacting portion 32, an upper retaining portion 34, an upper connecting portion 36, and an upper soldering portion 38. The upper soldering portion 38 is horizontal. Each lower contact 40 comprises, in sequence, a lower contacting portion 42, a lower retaining portion 44, a lower connecting portion 46, and a lower soldering portion 48. The lower soldering portion 48 is horizontal. A level at which the upper retaining portion 34 is defined is higher than a level at which the upper soldering portion 38 is defined. A level at which the lower retaining portion 44 is defined is lower than the level at which the lower soldering portion 48 is defined. Thus, the upper connecting portion 36 bends downwardly from the upper retaining portion 34 to the upper soldering portion 38, and the lower connecting portion 46 bends upwardly from the lower retaining portion 44 to the lower soldering portion 48.

Referring to FIG. 4, the PCB 50 comprises spaced conductive pads 52, 54 located on opposite surfaces of an edge portion thereof. The conductive pads 52, 54 are coated with solder (not shown).

Figure 3:
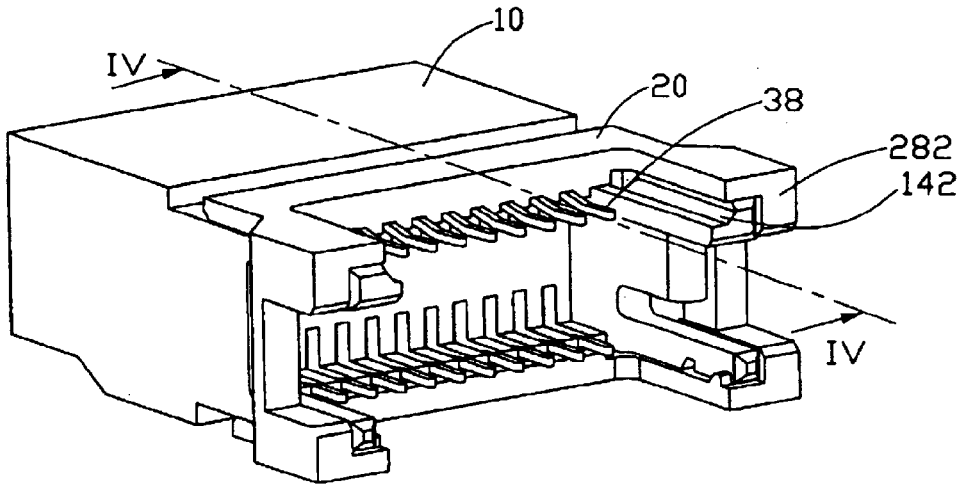
FIG. 3 is an assembled view of FIG. 1.

FIG. 3 is an assembled view of essential parts of the connector 1. The assembly of the essential parts of the connector 1 is as follows. Firstly, the upper contacts 30 are partly accommodated in the upper passageways 124, with the upper contacting portions 32 and the upper retaining portions 34 being received in the upper passageways 124. Similarly, the lower contacts 40 are partly accommodated in the lower passageways 126, with the lower contacting portions 42 and the lower retaining portions 44 being received in the lower passageways 126.

The clamp 20 is then attached to the housing 10. The upper arms 282 of the clamp 20 are respectively slid along tops of corresponding upper parts 142 of the extending portions 14 of the housing 10, and the lower arms 284 of the clamp 20 are respectively slid along bottoms of lower parts 144 of the extending portions 14 of the housing 10.

The clamp 20 is thus slid toward the body 12 of the housing 10. During this process, the upper parts 142 of the extending portions 14 of the housing 10 respectively get to engage with corresponding upper engaging surfaces 2822 of corresponding upper arms 282 of the clamp 20 via corresponding upper guiding portions 2826. The lower parts 144 of the extending portions 14 of the housing 10 respectively get to engage with corresponding lower engaging surfaces 2842 of corresponding lower arms 284 of the clamp 20 via corresponding lower guiding portions 2846.

When the blocks 2844 defined on the lower engaging surfaces 2842 of the clamp 20 engage in corresponding positioning slots 1442 of corresponding lower parts 144 of the housing 10, the upper soldering portions 38 and the upper connecting portions 36 of the upper contacts 30 are respectively received through corresponding first receiving slots 242 of the first receiving portion 24 via corresponding first guiding faces 2422, and the lower soldering portions 48 and the lower connecting portions 46 of the lower contacts 40 are respectively received through corresponding second receiving slots 262 of the second receiving portion 26 via corresponding guiding faces 2622 (shown in FIG. 4). At this position, a distance between the upper soldering portion 38 of each upper contact 30 and a corresponding lower soldering portion 48 of a corresponding lower contact 40 is greater than a thickness of the PCB 50.

Figure 5:
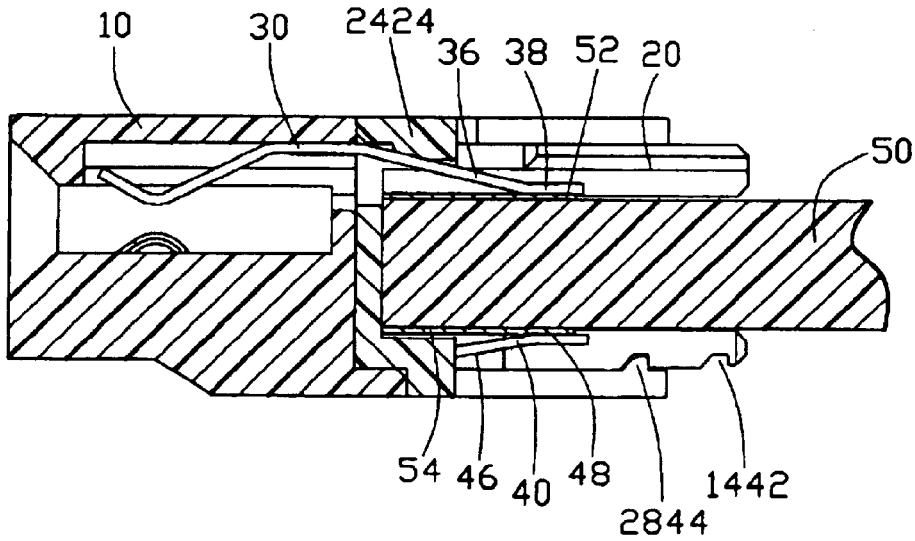
FIG. 5 is similar to FIG. 4, but showing the PCB completely inserted into the connector.
Figure 6:
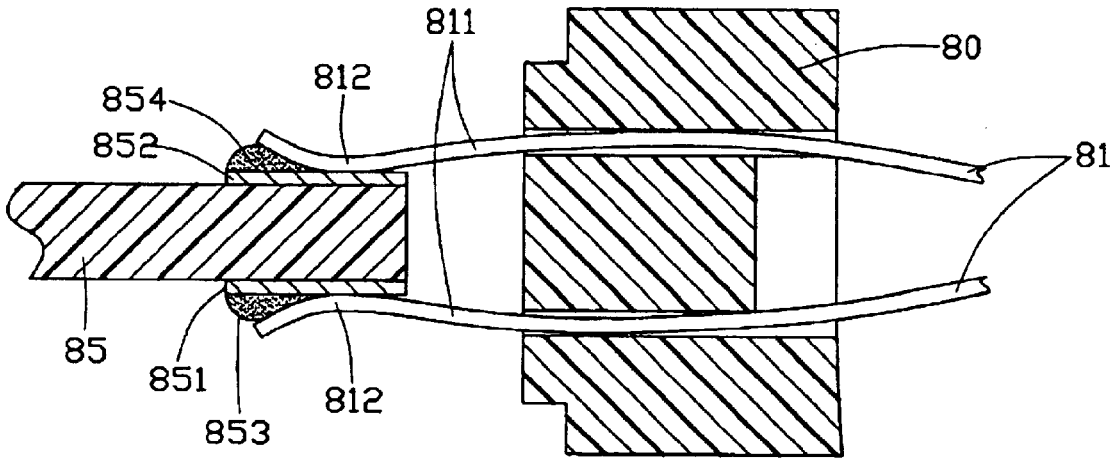
FIG. 6 (PRIOR ART)
FIG. 6 is a cross-sectional view of a conventional straddle electrical connector, and showing a PCB completely inserted into the connector.
Figure 7:
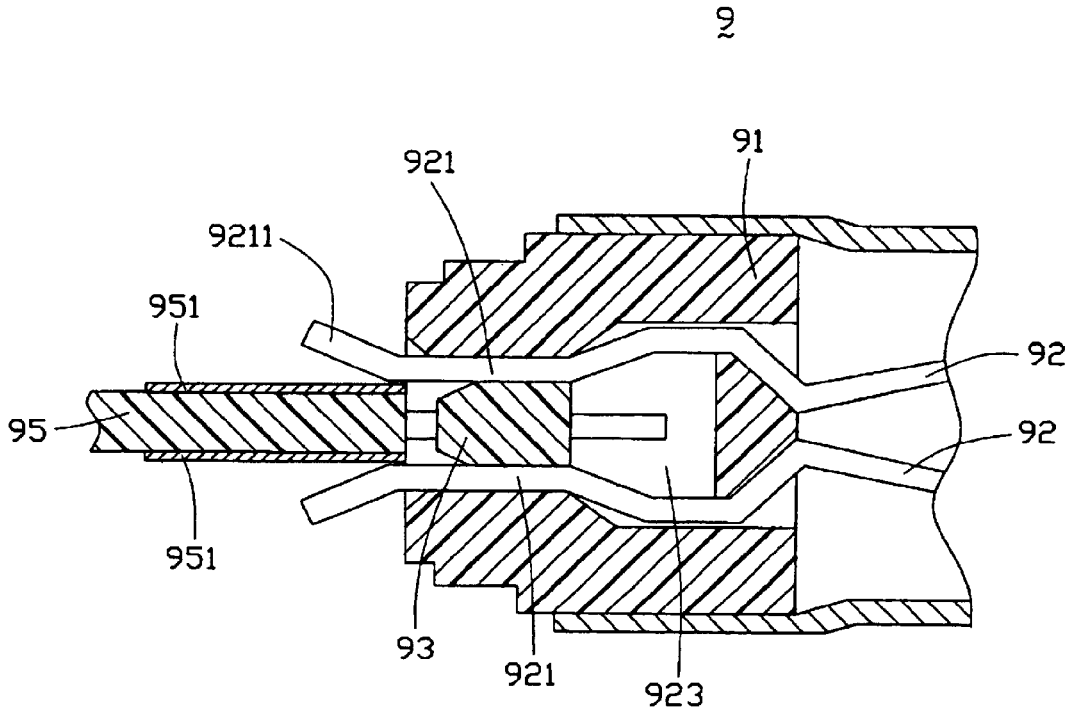
FIG. 7 (PRIOR ART)
FIG. 7 is a cross-sectional view of another conventional straddle electrical connector, and showing a PCB partly inserted into the connector.

FIG. 4 shows an edge of the PCB 50 is partly inserted in the connector 1. When the PCB 50 is being inserted in the connector 1, the PCB 50 does not contact the upper contacts 30 or the lower contacts 40. Rather, the PCB 50 makes direct contact with the front surface 222 of the clamp 20. When the PCB 50 is inserted further, the clamp 20 is pushed by the PCB 50 to slide toward the body 12 of the housing 10. FIG. 5 shows the edge of the PCB 50 is completely inserted in the connector 1. At this position, the blocks 2844 defined on the lower engaging surfaces 2842 of the clamp 20 engage in corresponding retaining slots 1444 of corresponding lower parts 144 of the housing 10. The back surface 224 of the clamp 20 abuts the contacting surface 122 of the housing 10. During this process, a distance between the upper connecting portion 36 of each upper contact 30 and a corresponding lower connecting portion 46 of a corresponding lower contact 40 becomes greater and greater. Thus, the first pressing blocks 2424 of the first receiving portion 24 press the upper contact 30 downwardly and corresponding second pressing blocks of the second receiving portion 26 press the lower contacts 40 upwardly. This results in the distance between the upper soldering portion 38 of each upper contact 30 and a corresponding lower soldering portion 48 of a corresponding lower contact 40 reduced. At this position, the distance between the upper soldering portion 38 of each upper contact 30 and a corresponding lower soldering portion 48 of a corresponding lower contact 40 is less than the thickness of the PCB 50. Thereby the upper soldering portion 38 of each upper contact 30 and a corresponding lower soldering portion 48 of a corresponding lower contact 40 cooperatively respectively resiliently press on the solder-coated conductive pads 52, 54 of the PCB 50. Then, the solder of the conductive pads 52, 54 is melted using an infrared light source or another kind of heat source. In this way, reliable SMT connections between the upper soldering portions 38, the lower soldering portions 48, and the corresponding conductive pads 52, 54 are obtained.

As detailed above, before the connector 1 is connected to the edge of the PCB 50, the distance between the upper soldering portion 38 of each upper contact 30 and a corresponding lower soldering portion 48 of a corresponding lower contact 40 is greater than the thickness of the PCB 50. Thus, the PCB 50 is freely accommodated in the connector 1. When the PCB 50 is inserted further, the clamp 20 presses the upper contacts 30 and corresponding lower contacts 40 face to face. The distance between the upper soldering portion 38 of each upper contact 30 and a corresponding lower soldering portion 48 of a corresponding lower contact 40 is reduced and less than the thickness of the PCB 50, thereby provide resilient contact between the upper and lower contacts 30, 40 and corresponding conductive pads 52, 54 of the PCB 50. This mechanism substantially reduces or even eliminates scraping off of solder from the conductive pads 52, 54 by the upper and lower contacts 30, 40. Thus strong and highly reliable SMT soldering connections are obtained.

In addition, the first slantwise guiding faces 2422 guide the upper contacts 30 through corresponding first receiving slots 242, and the second slantwise guiding faces 2622 guide the lower contacts 40 through corresponding second receiving slots 262. Therefore, the upper soldering portions 38 of the upper contacts 30 and the lower solder portions 48 of the lower contacts 40 do not need to be configured with their own guiding ends. The upper soldering portions 38 and the lower soldering portions 48 are horizontal, and molten solder can easily cover them completely. When the connector 1 transmits high-frequency signals, cross talk involving the distal ends is greatly reduced or even eliminated altogether. Thus, the connector 1 can be made to comply with very high performance and reliability specifications.

while the preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector assembly for connection to solder-coated conductive pads on both surfaces of a circuit substrate when completely inserted into the connector assembly, the electrical connector assembly comprising:

an insulative housing having a body with a row of upper and a row of lower receiving passageways defined therein, and a pair of extending portions formed at opposite ends of the body;

a clamp attached with the housing, the clamp comprising a plurality of first and second receiving slots, a plurality of first and second pressing blocks defined at the first and second receiving slots, and a pair of supporting portions engaging with corresponding extending portions of the housing;

a row of upper conductive contacts received in the row of upper receiving passageways of the housing and comprising upper connecting portions and upper soldering portions received in the first receiving slots of the clamp, the upper connecting portions bending downwardly with lower ends thereof adjoining with the upper soldering portions; and a row of lower conductive contacts received in the row of lower receiving passageways of the housing and comprising lower connecting portions and lower soldering portions received in the second receiving slots of the clamp, the lower connecting portions bending upwardly with upper ends thereof adjoining with the lower soldering portions;

wherein before the circuit substrate is completely inserted into the connector assembly, a shortest distance between the upper soldering portion of each upper contact and the lower soldering portion of a corresponding lower contact is greater than a thickness of the circuit substrate.

2. The electrical connector assembly as claimed in claim 1, wherein a plurality of first and second guiding faces are respectively defined in the clamp at the first and second receiving slots for guiding the upper and lower contacts through the first and second receiving slots.

3. The electrical connector assembly as claimed in claim 2, wherein the upper soldering portions of the upper contacts and the lower soldering portions of the lower contacts are horizontal.

4. The electrical connector assembly as claimed in claim 1, wherein each upper contact comprises an upper contacting portion and an upper retaining portion secured in corresponding upper receiving passageway of the housing, and each lower contact comprises a lower contacting portion and a lower retaining portion secured in corresponding lower receiving passageway of the housing.

5. The electrical connector assembly as claimed in claim 1, wherein each extending portion defines a positioning slot and a retaining slot in a bottom thereof.

6. The electrical connector assembly as claimed in claim 5, wherein the clamp further comprises a pair of blocks, and the blocks engage with the positioning slots and the retaining slots respectively before and after the circuit substrate being completely inserted into the connector assembly.

7. A clamp for being used with an electrical connector, the clamp comprising:

a first receiving portion with a plurality of first receiving slots defined therein;

a second receiving portion with a plurality of second receiving slots defined therein; and a pair of supporting portions respectively interconnecting opposite ends of the first receiving portion with corresponding opposite ends of the second receiving portion;

wherein the first receiving portion further forms a plurality of first pressing blocks at the first receiving slots, and the second receiving portion further forms a plurality of second pressing blocks at the second receiving slots.

8. The clamp as claimed in claim 7, wherein a plurality of first guiding faces is defined in the first receiving portion at corresponding first receiving slots, and a plurality of second guiding faces is defined in the second receiving portion at corresponding second receiving slots.

9. The clamp as claimed in claim 8, wherein the clamp further a base portion interconnecting the first receiving portion and the second receiving portion.

10. The clamp as claimed in claim 9, wherein each supporting portion comprises an upper arm and a lower arm.

11. The clamp as claimed in claim 10, wherein the upper arm defines an upper guiding portion at an end thereof, and the lower arm defines a lower guiding portion at an end thereof, the upper and lower guiding portions are near the base portion.

12. The clamp as claimed in claim 11, wherein a block is defined on an opposite end of the lower arm.

13. The clamp as claimed in claim 9, wherein the base portion comprises a row of upper through slot respectively communicating with corresponding first receiving slots of the first receiving portion, and a row of lower through slot communicating with corresponding second receiving slots of the second receiving portion.

14. An electrical connector assembly comprising:

an insulative housing;

a plurality of contacts disposed in the housing with tails extending out of a rear face of the housing;

a clamp moveably attached around a rear face of the housing; and a plurality of receiving slots defined in the clamp and receiving said tails of the corresponding contacts, respectively; wherein when said clamp is located at an outer position, the tails are in a relaxed manner so as to have a printed circuit board approach a space under said tails without interference; when said clamp is located at an inner position, the tails are in a deflected manner so as to the have the tails engaged with the printed circuit board thereunder.

15. The electrical connector assembly as claimed in claim 14, wherein said printed circuit board is associatively moved with the clamp when said clamp is moved from the outer position to the inner position.

* * * * *